US008845272B2

(12) United States Patent
Weber et al.

(10) Patent No.: US 8,845,272 B2
(45) Date of Patent: Sep. 30, 2014

(54) TURBINE SHROUD AND A METHOD FOR MANUFACTURING THE TURBINE SHROUD

(75) Inventors: David Wayne Weber, Simpsonville, SC (US); Gregory Thomas Foster, Greer, SC (US)

(73) Assignee: General Electric Company, Schenectady, NY (US)

( * ) Notice: Subject to any disclaimer, the term of this patent is extended or adjusted under 35 U.S.C. 154(b) by 848 days.

(21) Appl. No.: 13/034,810

(22) Filed: Feb. 25, 2011

(65) Prior Publication Data

US 2012/0219404 A1 Aug. 30, 2012

(51) Int. Cl.

| | |
|---|---|
| ***F01D 11/08*** | (2006.01) |
| ***F01D 9/04*** | (2006.01) |
| ***F01D 25/24*** | (2006.01) |
| ***F01D 25/12*** | (2006.01) |

(52) U.S. Cl.

CPC ..... *F01D 11/08* (2013.01); *F05D 2260/20* (2013.01); *F01D 9/04* (2013.01); *F01D 25/246* (2013.01); *F01D 25/12* (2013.01)

USPC ..... 415/115; 415/173.1

(58) Field of Classification Search

USPC ..... 415/115, 170.1, 173.1, 173.4, 173.6, 415/173.7, 134

See application file for complete search history.

(56) References Cited

U.S. PATENT DOCUMENTS

| | | | |
|---|---|---|---|
| 2,924,471 | A | 2/1960 | Poltorak et al. |
| 3,020,185 | A | 2/1962 | Moffitt, Jr. et al. |
| 3,476,842 | A | 11/1969 | Renwick |
| 4,220,342 | A | 9/1980 | Shah |
| 4,226,429 | A | 10/1980 | Sato et al. |
| 4,318,668 | A | 3/1982 | Chaplin et al. |
| 4,462,603 | A | 7/1984 | Usher et al. |
| 4,540,183 | A | 9/1985 | Schneider et al. |
| 4,902,198 | A | 2/1990 | North |
| 5,209,503 | A | 5/1993 | Heibel et al. |
| 5,407,214 | A | 4/1995 | Lew et al. |
| 5,509,669 | A | 4/1996 | Wolfe et al. |

(Continued)

FOREIGN PATENT DOCUMENTS

| | | |
|---|---|---|
| DE | 200 23 961 U1 | 12/2007 |
| EP | 0357984 | 3/1990 |

(Continued)

OTHER PUBLICATIONS

Design drawing of shroud, date of publication unknown.

*Primary Examiner* — Igor Kershteyn
*Assistant Examiner* — Woody A Lee, Jr.
(74) *Attorney, Agent, or Firm* — Dority & Manning, PA

(57) ABSTRACT

A turbine shroud includes a body having a plurality of sides. A first inward facing groove is defined by a first side of the body, and a first seal covers the first inward facing groove to define a first fluid passage in the first inward facing groove along the first side of the body. A first inlet port through the first seal fluid communication through the first seal into the first fluid passage. A method for forming a turbine shroud includes forming an inner surface and forming an outer surface opposed to the inner surface, wherein the outer surface is configured for exposure to a hot gas path. The method further includes defining a first slot in the inner surface and extending a first seal across the first slot to define a first fluid passage in the first slot along the inner surface.

19 Claims, 4 Drawing Sheets

(56) References Cited

U.S. PATENT DOCUMENTS

| | | | | |
|---|---|---|---|---|
| 5,657,998 | A | 8/1997 | Dinc et al. | |
| 5,705,916 | A | 1/1998 | Rudbeck et al. | |
| 5,716,052 | A | 2/1998 | Swensen et al. | |
| 5,823,741 | A * | 10/1998 | Predmore et al. | 415/134 |
| 5,934,687 | A | 8/1999 | Bagepalli et al. | |
| 5,957,657 | A | 9/1999 | Akita et al. | |
| 6,126,389 | A * | 10/2000 | Burdgick | 415/115 |
| 6,155,778 | A | 12/2000 | Lee et al. | |
| 6,162,014 | A | 12/2000 | Bagepalli et al. | |
| 6,446,979 | B1 | 9/2002 | Steinetz et al. | |
| 6,454,526 | B1 | 9/2002 | Cunha et al. | |
| 6,637,752 | B2 | 10/2003 | Aksit et al. | |
| 6,648,333 | B2 | 11/2003 | Aksit et al. | |
| 6,655,913 | B2 | 12/2003 | Vedantam et al. | |
| 6,659,472 | B2 | 12/2003 | Aksit et al. | |
| 6,692,227 | B2 | 2/2004 | Tomita et al. | |
| 6,726,448 | B2 | 4/2004 | McGrath et al. | |
| 6,764,081 | B2 | 7/2004 | Mohammed-Fakir et al. | |
| 6,783,323 | B2 | 8/2004 | Shiozaki et al. | |
| 6,843,479 | B2 | 1/2005 | Burdgick | |
| 6,896,484 | B2 * | 5/2005 | Diakunchak | 415/173.1 |
| 6,971,844 | B2 | 12/2005 | Burdgick | |
| 7,029,228 | B2 | 4/2006 | Chan et al. | |
| 7,033,138 | B2 | 4/2006 | Tomita et al. | |
| 7,040,857 | B2 | 5/2006 | Chiu et al. | |
| 7,076,957 | B2 | 7/2006 | Ahmed et al. | |
| 7,153,379 | B2 | 12/2006 | Millard et al. | |
| 7,168,914 | B2 | 1/2007 | Shiozaki et al. | |
| 7,284,954 | B2 | 10/2007 | Parker et al. | |
| 7,367,567 | B2 | 5/2008 | Farah et al. | |
| 7,467,517 | B2 | 12/2008 | Strain | |
| 7,665,962 | B1 * | 2/2010 | Liang | 415/173.1 |
| 7,704,039 | B1 * | 4/2010 | Liang | 415/116 |
| 8,475,122 | B1 * | 7/2013 | Liang | 415/173.1 |
| 2005/0232772 | A1 | 10/2005 | Race et al. | |
| 2006/0083620 | A1 | 4/2006 | Scheurlen | |
| 2007/0041827 | A1 | 2/2007 | Camus | |
| 2009/0229271 | A1 | 9/2009 | De Ruyck et al. | |
| 2009/0285675 | A1 | 11/2009 | Lewis et al. | |

FOREIGN PATENT DOCUMENTS

| | | |
|---|---|---|
| EP | 0856640 | 8/1998 |
| EP | 1221539 | 7/2002 |
| EP | 1 327 801 A2 | 7/2003 |
| EP | 2065566 | 6/2009 |
| EP | 2067974 | 6/2009 |
| EP | 2109173 | 10/2009 |
| EP | 2116621 | 11/2009 |
| EP | 2143887 | 1/2010 |
| GB | 2280935 | 2/1995 |
| JP | 2002372714 | 12/2002 |
| JP | 2007254563 | 10/2007 |

* cited by examiner

TURBINE SHROUD AND A METHOD FOR MANUFACTURING THE TURBINE SHROUD

FIELD OF THE INVENTION

The present invention generally involves a turbine shroud that may be located in a hot gas path of the turbine. Particular embodiments of the present invention may include a method for manufacturing the turbine shroud.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and the rotating blades may be attached to a rotor located along an axial centerline of the turbine. A compressed working fluid, such as steam, combustion gases, or air, flows along a gas path through the turbine to produce work. The stator vanes accelerate and direct the compressed working fluid onto the subsequent stage of rotating blades to impart motion to the rotating blades, thus turning the rotor and performing work. Compressed working fluid that leaks around or bypasses the stator vanes or rotating blades reduces the efficiency of the turbine. As a result, the casing surrounding the turbine often includes an inner shell of shrouds or shroud segments that surround and define the outer perimeter of the gas path to reduce the amount of compressed working fluid that bypasses the stator vanes or rotating blades.

Continuous exposure of the turbine shroud to the gas path may result in excessive heating and/or failure of the outer surface of the turbine shroud, particularly in the case of turbines that operate with high temperature compressed working fluids, such as gas and steam turbines. Although several systems and methods have been developed to cool the turbine shroud, the ability to efficiently and cost-effectively cool the outer surface of the turbine shroud remains difficult. For example, U.S. Pat. No. 5,957,657 describes a method for forming a cooling passage in a turbine shroud that includes forming a groove in the outer surface of the turbine shroud and covering the groove with a plug to form the cooling passage along the outer surface. Although the outward facing cooling passage may be easily machined into existing shrouds, continuous exposure of the plug to the gas path and associated temperature changes in the gas path may weaken and/or damage the plug, possibly introducing damaging debris into the gas path. U.S. Pat. No. 7,284,954 describes a turbine shroud that includes a plurality of fluid passages machined into the turbine shroud, and a cooling fluid, such as compressed air, may be supplied through the various fluid passages to cool the outer surface of the turbine shroud. Although U.S. Pat. No. 7,284,954 overcomes the previous disadvantages of exposing a plug to the gas path, the machining required to form the fluid passages may be relatively difficult, time-consuming, and expensive to accomplish. In addition, although the fluid passages communicate the cooling fluid to the outer surface of the turbine shroud, the relatively high flow rate of the cooling fluid through the fluid passages under-utilizes the heat capacity of the cooling fluid. As a result, continued improvements in systems to cool turbine shrouds and methods of manufacturing turbine shrouds would be useful.

BRIEF DESCRIPTION OF THE INVENTION

Aspects and advantages of the invention are set forth below in the following description, or may be obvious from the description, or may be learned through practice of the invention.

One embodiment of the present invention is a turbine shroud that includes a body having a plurality of sides. A first inward facing groove is defined by a first side of the body, and a first seal covers the first inward facing groove to define a first fluid passage in the first inward facing groove along the first side of the body. A first inlet port is through the first seal and provides fluid communication through the first seal into the first fluid passage.

Another embodiment of the present invention is a turbine shroud that includes an inner surface and an outer surface opposed to the inner surface. The outer surface is configured for exposure to a hot gas path. A first slot is defined by the inner surface, and a first seal extends across the first slot to define a first fluid passage in the first slot along the inner surface.

Particular embodiments of the present invention may also include a method for forming a turbine shroud. The method includes forming an inner surface and forming an outer surface opposed to the inner surface, wherein the outer surface is configured for exposure to a hot gas path. The method further includes defining a first slot in the inner surface and extending a first seal across the first slot to define a first fluid passage in the first slot along the inner surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
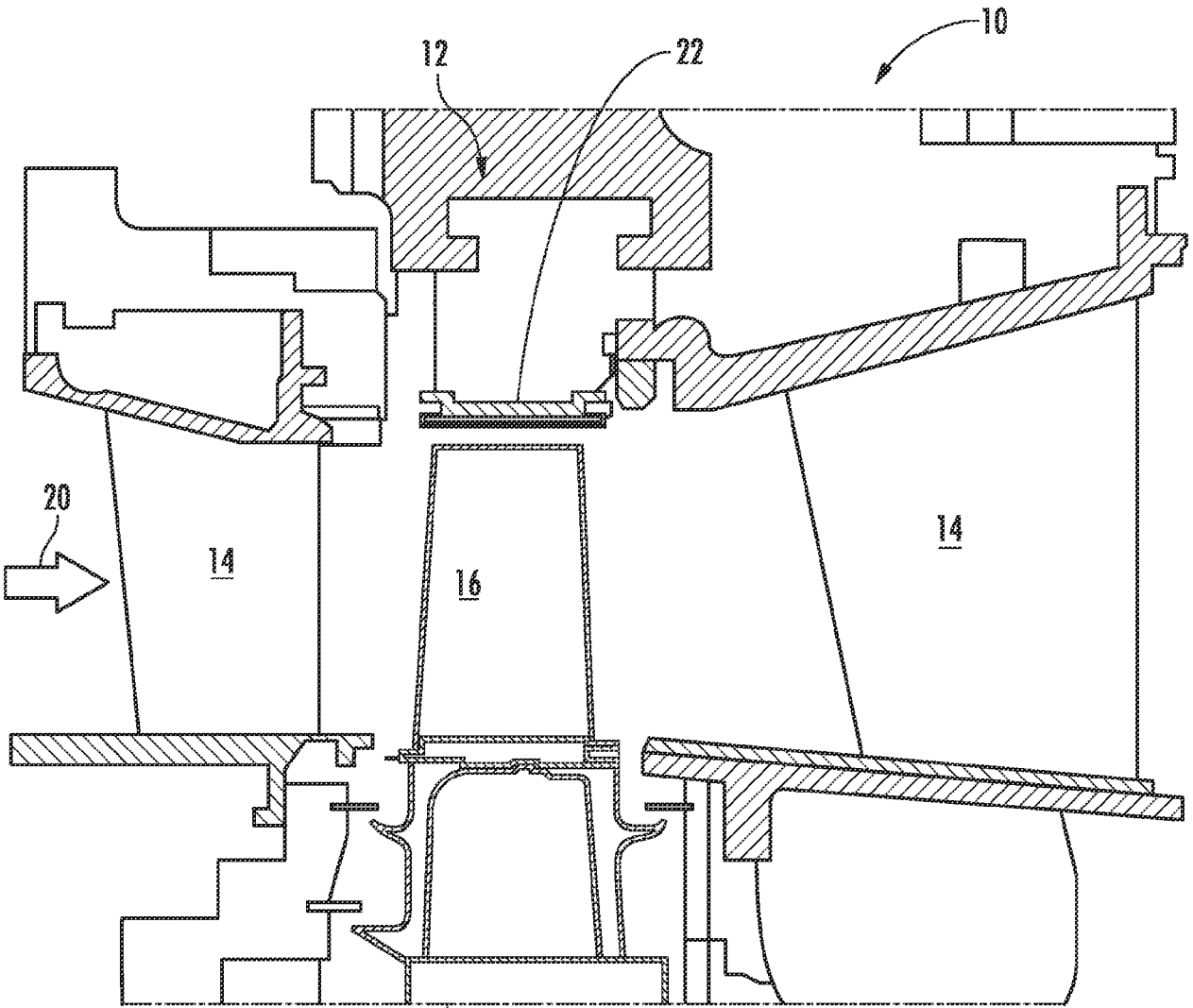
FIG. 1 is a simplified cross-section view of a turbine according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

FIG. 1 provides a simplified cross-section view of a portion of a turbine 10 according to one embodiment of the present invention. As shown in FIG. 1, the turbine 10 may include stationary and rotating components surrounded by a casing 12. The stationary components may include, for example, stationary nozzles or stator vanes 14 attached to the casing 12. The rotating components may include, for example, rotating blades 16 attached to a rotor 18. A compressed working fluid 20, such as steam, combustion gases, or air, flows along a hot gas path through the turbine 10 from left to right as shown in FIG. 1. The first stage of stator vanes 14 accelerates and directs the compressed working fluid 20 onto the first stage of rotating blades 16, causing the first stage of rotating blades 16 and rotor 18 to rotate. The compressed working fluid 20 then flows across the second stage of stator vanes 14 which accelerates and redirects the compressed working fluid 20 to the next stage of rotating blades (not shown), and the process repeats for each subsequent stage.

As shown in FIG. 1, the radially inward portion of the casing 12 comprises a series of segmented shrouds 22 connected to the casing 12 that circumferentially surround and define the hot gas path to reduce the amount of compressed working fluid 20 that bypasses the stator vanes 14 or rotating blades 16. As used herein, the term "shroud" may encompass and include virtually any static or stationary hardware in the hot gas path exposed to the temperatures and pressures associated with the compressed working fluid 20. For example, in the particular embodiment shown in FIG. 1, the shroud 22 is located radially outward of the rotating blades 16, while in other particular embodiments the shroud 22 may also be located radially inward of the rotating blades 16 or radially inward or outward of the stator vanes 14.

Figure 2:
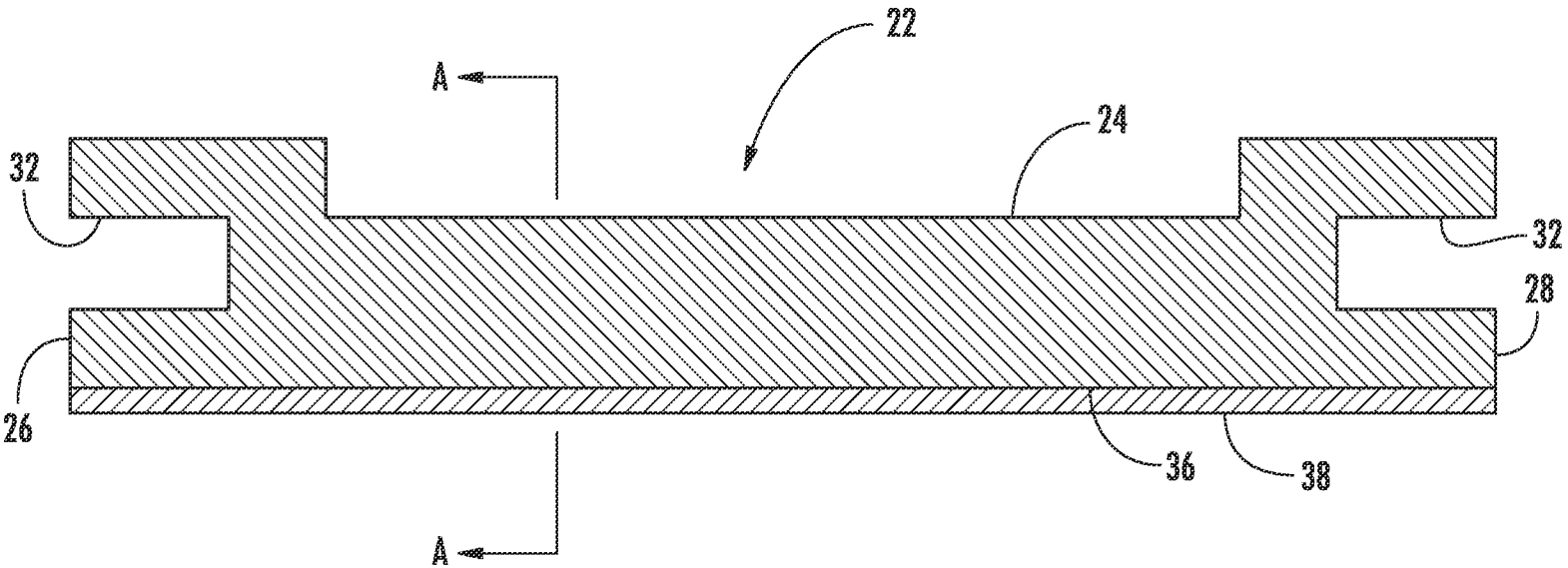
FIG. 2 is an enlarged side cross-section view of the shroud shown in FIG. 1 according to one embodiment of the present invention.
Figure 3:
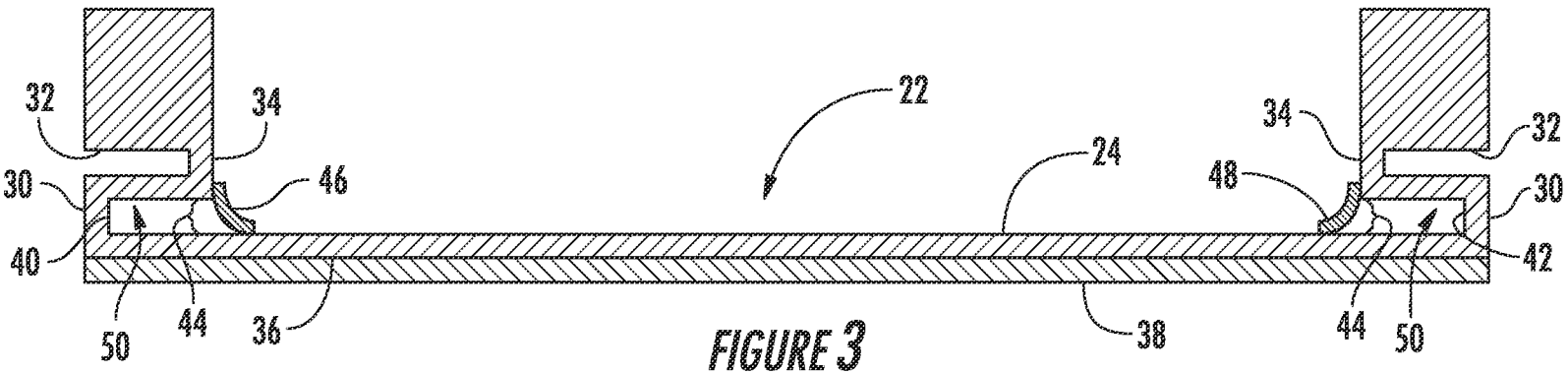
FIG. 3 is an axial cross-section view of the shroud shown in FIG. 2 taken along line A-A.
Figure 4:
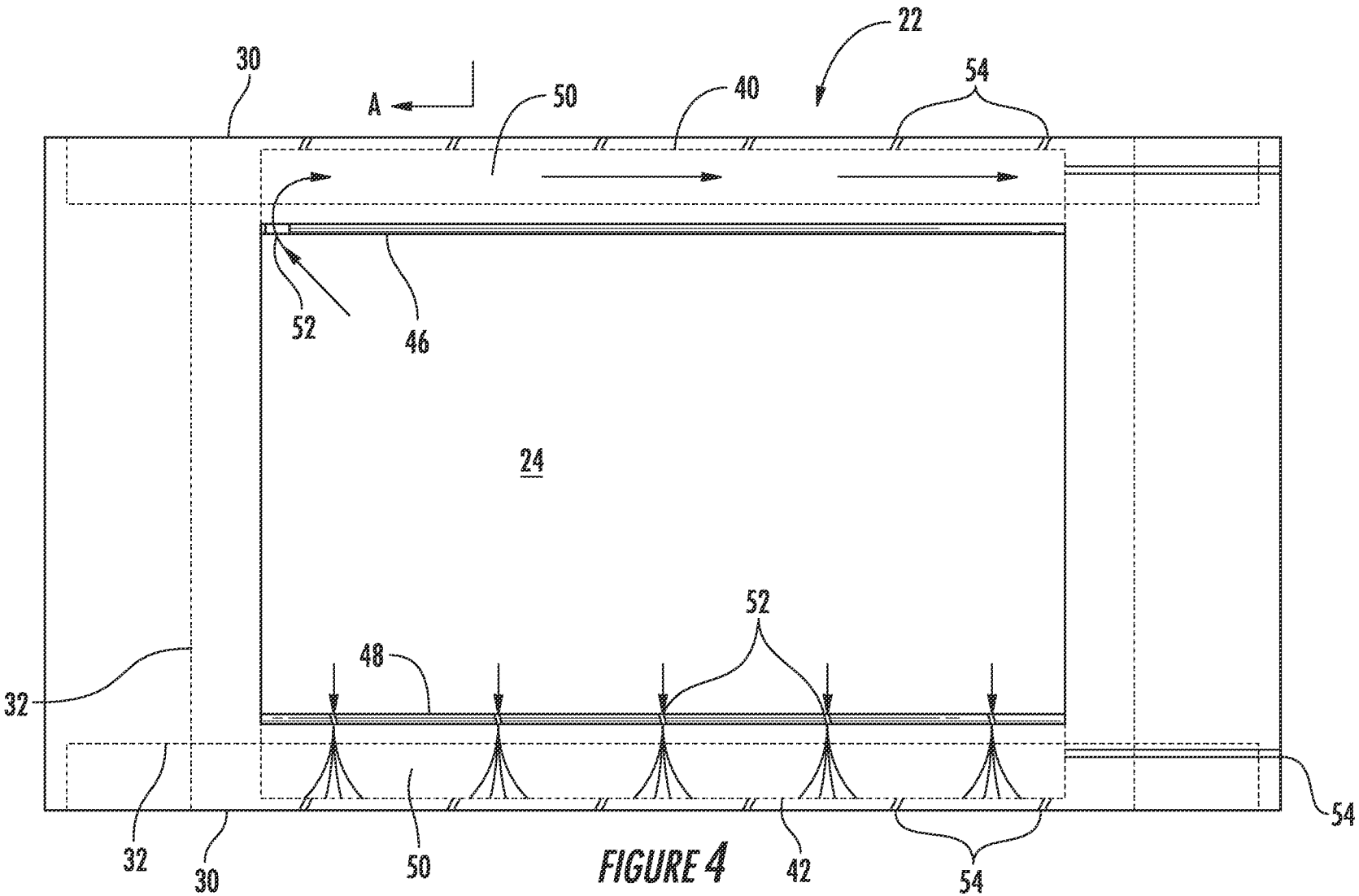
FIG. 4 is a top plan view of the shroud shown in FIG. 2.

FIG. 2 provides an enlarged side cross-section view of the shroud 22 shown in FIG. 1 according to one embodiment of the present invention. FIG. 3 provides an axial cross-section view of the shroud 22 shown in FIG. 2 taken along line A-A, and FIG. 4 provides a top plan view of the shroud 22 shown in FIG. 2. As shown in FIGS. 2-4, the shroud 22 generally comprises a body 24 having a plurality of sides. Specifically, front and rear sides 26, 28 and lateral sides 30 may be configured to connect to or mate with adjacent shrouds (not shown). For example, as shown most clearly in FIGS. 2 and 3, the front 26, rear 28, and/or lateral sides 30 may include a notch or indent 32 to accommodate a pin or segment (not shown). The pin or segment may fit in the notches or indents 32 between adjacent shrouds or casing 12 to flexibly hold the shroud 22 in place while still minimizing or preventing compressed working fluid 20 from escaping from the hot gas path between the adjacent shrouds. In addition, the body 24 may comprise an inner surface 34 and an outer surface 36 opposed to the inner surface 34. As used herein, the inner surface 34 refers to the surface of the body 24 facing away from the hot gas path, and the outer surface 36 refers to the surface of the body 24 facing toward the hot gas path and configured for exposure to the hot gas path. For example, as shown most clearly in FIGS. 2 and 3, the outer surface 36 of the body 24 may include a thermal barrier coating 38 or other heat resistant surface to protect the outer surface 36 from excessive temperatures present in the hot gas path.

The shroud 22 further includes one or more inward facing grooves or slots formed in or defined by the sides 26, 28, 30 and/or inner surface 34. As used herein, the terms "grooves" and "slots" are meant to be interchangeable and encompass or include any channel, crevice, notch, or indent defined by the sides 26, 28, 30 and/or inner surface 34. Specifically, the inward facing groove(s) or slot(s) may extend laterally across a width of the front and/or rear sides 26, 28 and/or axially along a length of one or both of the lateral sides 30. For example, as shown in FIGS. 2 and 3, first and second inward facing grooves or slots 40, 42 may be defined by the lateral sides 30 and/or inner surface 34 so that the inward facing grooves or slots 40, 42 extend axially along a length of the body 24. The inward facing grooves or slots 40, 42 may be formed in the sides 26, 28, 30 and/or inner surface 34 by conventional machining, such as by grinding the groove or slot 40, 42 into the sides 26, 28, 30 and/or inner surface 34. Alternately, the body 24 may be forged or cast around a suitable mold, thereby defining the inward facing grooves or slots 40, 42 at the desired location in the sides 26, 28, 30 and/or inner surface 34.

As seen most clearly in FIGS. 3 and 4, the shroud 22 further includes a seal connected, for example by welding or brazing, to the side 26, 28, 30 and/or inner surface 34 proximate to an opening 44 created by each inward facing groove or slot 40, 42. For example, a first seal 46 may cover the opening 44 in the first inward facing groove or slot 40, and a second seal 48 may cover the opening 44 in the second groove or slot 42. In this manner, each seal 46, 48 covers, spans, or extends across the opening 44 created by the inward facing grooves or slots 40, 42 to define fluid passages 50 in the respective grooves or slots 40, 42. Each seal 46, 48 may include one or more inlet ports 52 through the seal 46, 48 that provide fluid communication through the seal 46, 48 and into the proximate or associated fluid passage 50. In addition, the shroud 22 or body 24 may further include one or more outlet ports 54 through the sides 26, 28, 30 and/or outer surface 36 of the body 24. The outlet ports 54 may be located along the side 26, 28, 30 proximate to or associated with each fluid passage 50 to provide fluid communication from the fluid passage 50 through the proximate or associated side 26, 28, 30 and/or outer surface 36. In this manner, the combination of inlet ports 52 and outlet ports 54 may provide a continuous fluid pathway through each seal 46, 48, into the proximate or associated fluid passage 50, and out of the proximate or associated side 26, 28, 30 or outer surface 36.

As shown most clearly in FIG. 4, a fluid may be provided to each shroud 22 to remove heat from or cool the shroud 22. The fluid may comprise, for example, compressed air, an inert gas, or steam, and the present invention is not limited to any particular fluid used to cool the shroud 22. The fluid may first impact the center portion of the body 24 to provide impingement cooling to the bulk of the body 24. The fluid may then flow through one or more inlet ports 52 to pass through the seals 46, 48 and into the fluid passages 50 to remove heat from the sides 26, 28, 30 of the body 24. For example, as shown at the bottom of FIG. 4, inlet ports 52 arranged along the second seal 48 may direct the fluid through the second seal 48 and against the side 30 of the body 24 to provide additional impingement cooling to the side 30 of the body 24. The fluid may then flow through the fluid passage 50 to remove additional heat from the side 30 and bottom surface 36 of the body 24 through convective cooling before exiting the fluid passage 50 through the outlet ports 54. Alternately, or in addition, as shown at the top of FIG. 4, the inlet port 52 located at one end of the first seal 46 may direct the fluid through the first seal 46 into the fluid passage 50, and the fluid may then flow through the fluid passage 50 to remove heat from the side 30 of the body 24 through convective cooling before exiting the fluid passage 50 through the outlet ports 54.

It is anticipated that the various embodiments of the shroud 22 shown in FIGS. 2-4 may be manufactured at lower costs than previous cast designs. Specifically, the body 24 of the shroud 22 may be cast or forged to form the front side 26, rear side 28, lateral sides 30, inner surface 34, and the outer surface 36, as previously described. Concurrently or separately, the inward facing grooves or slots 40, 42 may be defined in the sides 26, 28, 30 and/or inner surface 34 by machining, casting, or forging, and the seals 46, 48 may be welded or brazed to the sides 26, 28, 30 and/or inner surface 34 so that the seals 46, 48 extend across each groove or slot 40, 42 to define the proximate or associated fluid passage 50 therein. The inlet and or outlet ports 52, 54 may be readily machined into the respective seals 46, 48 and/or sides 26, 28, 30 and/or outer surface 36, for example by drilling. In this manner, the shroud 22 may be readily manufactured to include the desired fluid passages 50 that provide cooling to the sides 26, 28, 30 and outer surface 36, and the seals 46, 48 forming the fluid passages 50 will not be exposed to the hot gas path.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine shroud comprising:

a. a body having a plurality of sides and a floor portion, wherein the plurality of sides extend radially outwardly from the floor portion;

b. a first inward facing groove defined by the body along a first lateral side of the body proximate to the floor portion;

c. a first seal covering the first inward facing groove to define a first fluid passage in the first inward facing groove along the first side of the body, wherein the first seal is connected to the first lateral side and to the floor portion; and d. a first inlet port through the first seal, wherein the first inlet port provides fluid communication through the first seal into the first fluid passage.

2. The turbine shroud as in claim 1, further comprising at least one outlet port through the first side of the body, wherein the at least one outlet port provides fluid communication from the first fluid passage through the first side of the body.

3. The turbine shroud as in claim 1, further comprising a continuous fluid pathway through the first seal, into the first fluid passage, and out of the first side of the body.

4. The turbine shroud as in claim 1, wherein the first seal is welded or brazed across the first inward facing groove.

5. The turbine shroud as in claim 1, wherein the first inward facing groove extends axially along a length of the body.

6. The turbine shroud as in claim 1, further comprising a second inward facing groove defined by the body along a second side of the body proximate to the floor portion and a second seal covering the second inward facing groove to define a second fluid passage in the second inward facing groove along the second side of the body, wherein the second seal is connected to the second lateral side and to the floor portion.

7. The turbine shroud as in claim 6, further comprising a second inlet port through the second seal, wherein the second inlet port provides fluid communication through the second seal into the second fluid passage.

8. A turbine shroud comprising:

a. a body having an inner surface at least partially defined along an intersection between a first lateral side and a floor protion of the body;

b. an outer surface opposed to the inner surface, wherein the outer surface is configured for exposure to a hot gas path;

c. a first slot defined by the body along the first lateral side;

d. a first seal extending across the first slot to define a first fluid passage in the first slot, wherein the first seal is connected to the body along the first lateral side and the floor protion;

e. a first inlet port through the first seal, wherein the first inlet port provides fluid communication through the first seal into the first fluid passage; and f. wherein the first inlet port is oriented to direct a fluid towards an inner surface of the first lateral side.

9. The turbine shroud as in claim 8, further comprising at least one outlet port through the outer surface, wherein the at least one outlet port provides fluid communication from the first fluid passage through the outer surface.

10. The turbine shroud as in claim 8, further comprising a continuous fluid pathway through the first seal, into the first fluid passage, and out of the outer surface.

11. The turbine shroud as in claim 8, wherein the first seal is connected to the inner surface.

12. The turbine shroud as in claim 8, further comprising a second slot defined by the body along a second lateral side and a second seal extending across the second slot to define a second fluid passage in the second slot along the inner surface wherein the second seal is connected to the second lateral side and to the floor portion.

13. The turbine shroud as in claim 12, further comprising a second inlet port through the second seal, wherein the second inlet port provides fluid communication through the second seal into the second fluid passage.

14. A method for forming a turbine shroud comprising:

a. forming a floor portion of a shroud body;

b. forming a first lateral side that extends substantially perpendicular to the floor portion, wherein the floor portion the first lateral side at least partially define an inner surface of the shroud body;

c. forming an outer surface opposed to the inner surface, wherein the outer surface is configured for exposure to a hot gas path;

d. defining a first slot in the body along the first lateral side; and e. extending a first seal across the first slot to define a first fluid passage in the first slot along the inner surface, wherein the first seal is connected to the shroud body along the first lateral side and the floor portion.

15. The method as in claim 14, futher comprising forming a first inlet port through the first seal, wherein the first inlet port provides fluid communication through the first seal into the first fluid passage.

16. The method as in claim 14, further comprising forming at least one output port through the outer surface.

17. The method as in claim 14, further comprising welding or brazing the first seal to the inner surface.

18. The method as in claim 14, further comprising forming a second lateral side that extends substantially perpendicular to the inner surface, defining a second slot in the body along the second lateral side and extending a second seal across the second slot to define a second fluid passage in the second slot along the inner surface, wherein the second seal iS connected to the body along the first lateral side and the floor portion.

19. The turbine shroud as in claim 18, further comprising forming a second inlet port through the second seal, wherein the second inlet port provides fluid communication through the second seal into the second fluid passage.

* * * * *